United States Patent [19]

Dolan

[11] 4,027,830

[45] June 7, 1977

[54] YARN SUPPORT

[75] Inventor: Thomas Albert Dolan, Old Hickory, Tenn.

[73] Assignee: E. I. Du Pont de Nemours and Company, Wilmington, Del.

[22] Filed: Nov. 5, 1975

[21] Appl. No.: 628,955

[52] U.S. Cl. ..... 242/118.32; 93/1 S

[51] Int. Cl.[2] ..... B65H 75/10

[58] Field of Search ..... 242/118.32, 118.31, 242/118.8, 125.1, 18 PW, 118; 93/1 S

[56] References Cited

UNITED STATES PATENTS

| | | | |
|---|---|---|---|
| 1,896,135 | 2/1933 | Dunlap | 242/118.32 |
| 2,597,960 | 5/1952 | Stearn | 242/118.32 |
| 3,103,305 | 9/1963 | Heatherly | 242/125.1 |
| 3,544,034 | 12/1970 | Jurney | 242/118.32 |
| 3,794,260 | 2/1974 | Sowell | 242/18 PW |
| R23,046 | 10/1948 | Blanchet | 242/118.31 |

*Primary Examiner*—George F. Mautz

[57] ABSTRACT

Yarn support comprising an inexpensive compressible core, especially of laminated paperboard, with a water-resistant covering, especially of parchment, with the improved feature that the unwinding end is covered by parchment with a smooth transition from the winding surface to this covered end, so as to avoid snagging of the yarn during unwinding. Such yarn support may be prepared economically by making partial internal and external cuts through the core material and removing the end portion to give an external flap of axial length equal to the wall thickness of the support, and burnishing to fold and smooth this flap over the exposed ends of the inner layers of core material, to compress the core material in the flap against the ends of the inner layers to give a rounded configuration and to fair the flap into the internal surface of the support.

8 Claims, 9 Drawing Figures

YARN SUPPORT

BACKGROUND OF THE INVENTION

This invention relates to an improvement in a support for winding yarn. The term "yarn" is intended herein to include textile yarns and other forms of yarns, e.g., industrial yarn, including monofilament and multifilament yarns with or without twist, interlacing or other entanglements, including threads. Such yarn supports are referred to sometimes by other names, such as bobbins, cores, spools and tubes.

Yarn supports are used daily in large quantities for winding packages of synthetic yarns at high speeds. Prior art supports are described, for example, in Heatherly U.S. Pat. No. 3,103,305, Sowell U.S. Pat. No. 3,284,023 and Sowell U.S. Pat. No. 3,794,260, all of which disclose yarn supports with a 'string-up slot' for winding a 'transfer tail'. Such yarn supports are conventionally made from an inexpensive compressible core material such as Kraft paper-board, with an external covering of water-resistant material, such as parchment paper, generally referred to as "parchment" in the trade. Conventionally, these yarn supports are made by spiral winding of the paperboard layers and the external covering to provide cylindrical stock in appropriate lengths, e.g. of about 3 meters, of the appropriate diameter and wall thickness, followed by cutting these lengths into sections according to the size required for the individual yarn supports.

It is important that yarn supports be available cheaply and yet within close dimensional specifications. They should be inexpensive because they are generally not reusable by synthetic yarn manufacturers. If they do not meet critical dimensional specifications, they will be unsuitable for use with high-speed machinery. Thus, it is important that both the internal diameter (ID) and the length be within a close tolerance to permit use of more than one support on a single spindle. The length of a support with a string-up slot should be within a close tolerance to give the precise length of transfer tail; as the speeds of yarn winding machinery increase, so even small changes in the length of the yarn support can cause large differences in the length of the transfer tail.

The yarn is normally unwound from the support over the end remote from the transfer tail. It is important to avoid snagging of the yarn as it passes over the end of the support, otherwise the yarn may break or at least contain a defect which will be revealed in the final fabric. Although the customary construction of yarn supports, as mentioned above, is low in cost and satisfactory in many respects, there have been complaints about existing designs because of the frequency of snagging.

It has been conventional practice to smooth the end of the yarn support, e.g. by burnishing with high pressure. Several methods for smoothing the ends of yarn supports are discussed in Dunlap U.S. Pat. No. 1,896,135. Burnishing is an easy, economic process which provides the possibility of carefully controlling the length of the support within a required tolerance. It is still, however, desired to improve the smoothness beyond what is possible by mere burnishing, so as to reduce the frequency of snagging. It has been attempted to increase the effectiveness of burnishing by first tapering the cut end of the yarn support, but this has not sufficiently reduced the amount of snagging.

The frequency of snagging has been sufficient to cause many processors to use plastic caps which slide over the end of the yarn support, and thus avoid the hazard. Although these caps reduce the problems of snags, they are an additional expense, and manpower must be provided to position and recover the caps at the beginning and end of each processing operation. It would be desirable to provide a yarn support which could be relied on to avoid snags without the necessity for using such a cap.

I believe that much of the snagging has been a result of deformation of the end of the support. Such deformation can occur during handling of cartons containing several layers of yarn packages, especially if moisture has been able to penetrate the paperboard core where it has not been protected by a water-resistant covering.

BRIEF SUMMARY OF THE INVENTION

According to the present invention, there is provided a hollow laminated yarn support comprising superposed bonded layers of core materials with an external surface of water-resistant covering material and an internal surface, a flap of the covering material and of at least the outermost layer(s) of core material abutting one end of the remaining inner layers of core material, said flap being faired into the internal surface of the support, whereby the flap protects an end of the support to present a snag-free surface on at least its external face.

There is also provided a process for preparing such a yarn support for spirally-wound laminated stock comprising superposed bonded layers of core material with an external water-resistant covering material, comprising the steps of:

A. Cutting into the external and internal surfaces of the stock at locations that are separated axially from each other, and to depths such as to sever at both locations at least one common glue line between the layers of core material;

B. Removing an end portion by breaking and shearing along said common glue line to leave an external flap extending beyond the remainder of the stock by an axial distance essentially equal to the wall thickness of the stock and comprising the water-resistant covering material and at least the outermost layer(s) of the core material; and C. Burnishing to fold said external flap radially inwards over the remaining layers of core material, the stretch and smooth the water-resistant covering material to a snag-free external surface and to compress said outermost layer(s) of the core material against the end of said remaining layers of core material, and to fair the extremity of the flap against the innermost layer of core material on its internal surface.

DETAILED DESCRIPTION OF ILLUSTRATED EMBODIMENTS

Figure 1:
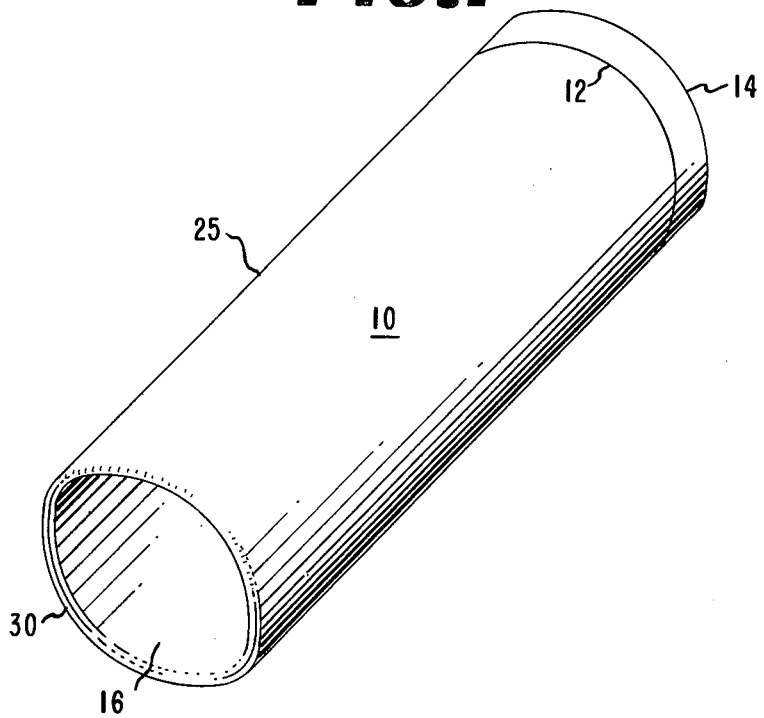
FIG. 1 is a perspective view of a typical cylindrical yarn support according to the present invention.

As illustrated in FIG. 1, yarn support 10 is of generally hollow cylindrical configuration with an external covering 25. Such yarn supports conventionally contain a string-up slot 12 near one end 14. The other end 30 presents an essentially smooth snag-free contour of covering material 25 and is of essentially constant internal diameter and smooth internal surface 16, especially at the interface with end 30, according to the present invention. If no string-up slot 12 is needed, and it is desired to be able to unwind yarn from either end of the support 10, both ends may have the configuration of end 30, but this embodiment is not shown in the drawing.

Figure 2:
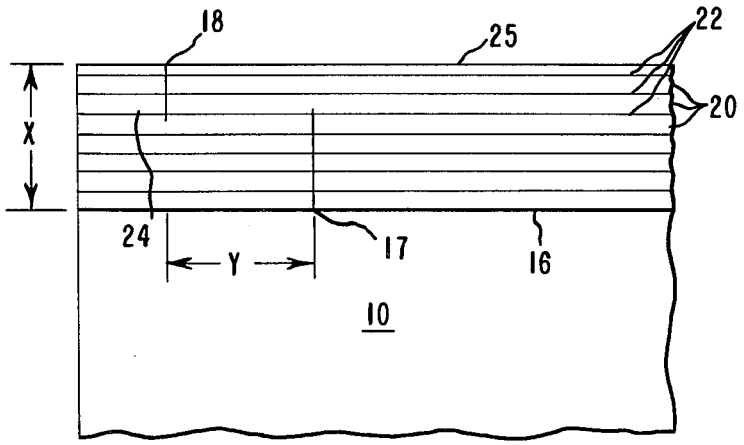
FIGS. 2, 3 and 4 are views in partial cross-section to show intermediate stages in the preparation of the end of such a support using a preferred process of the present invention.

FIG. 2 shows in partial cross-section one end of a section of cylindrical stock comprising several layers 20 of core material bonded with glue lines 22, and an external covering or surface 25. Essentially perpendicular cuts 17 and 18 are made into the internal and external surfaces 16 and 25, respectively, of depth such that they cut through at least one common glue line 24 between layers 20, and axially-separated by a distance Y that is essentially the same as the wall thickness X of the stock. Internal cut 17 should preferably not penetrate the glue line between the outermost layers 20 of core material, so that at least the outermost layer of core material is not substantially weakened by internal cut 17.

Figure 3:
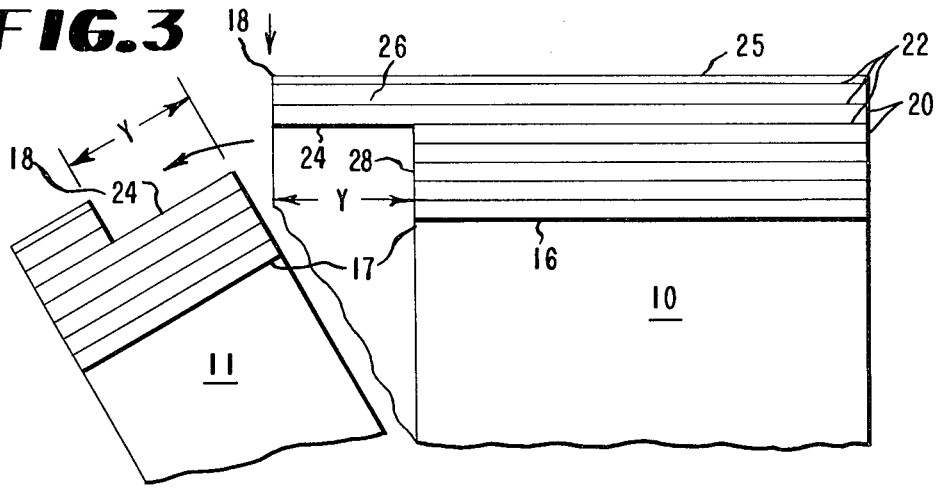

As illustrated in FIG. 3, end portion 11 may be separated from the remainder of the section by breaking part of portion 11 away so as to shear along the portion of common glue line 24 between cuts 17 and 18, and pulling portion 11 away from the remainder which will be support 10. This leaves a cylindrical flap 26 comprising covering 25 and adjacent outermost layer(s) of core material extending axially by a distance Y beyond face 28 comprising the annular ends of inner layers 20 exposed by cut 17.

Figure 4:
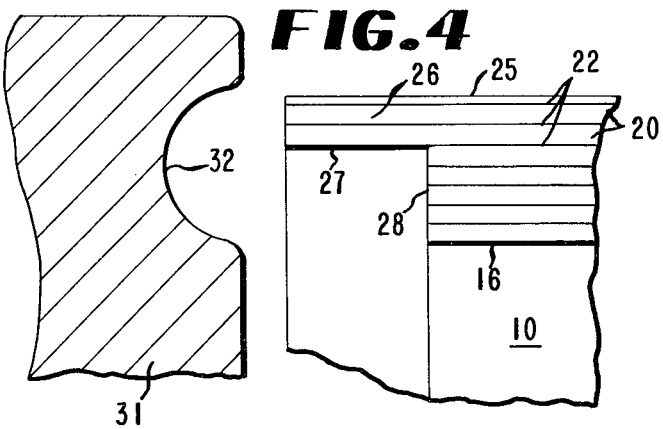
Figure 5:
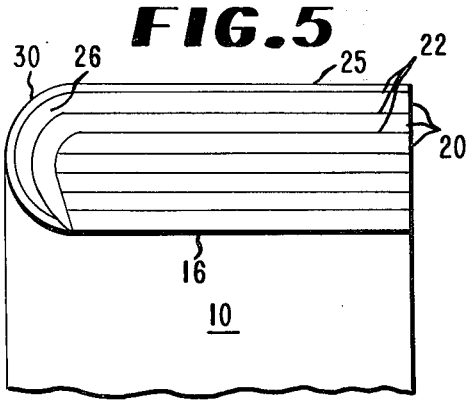
FIG. 5 is a view in partial cross-section of the end of one embodiment of the present invention obtained by the process illustrated by the stages shown in FIGS. 2, 3 and 4.

As illustrated in FIG. 4, a burnishing tool 31 is brought to the end of support 10, with dished annular cavity 32 aligned with the annular end of support 10. Burnishing tool 31 is operated so as to give the configuration desired to end 30 of the yarn support. Thus burnishing tool 31 is operated to (1) fold flap 26 radially down so that the inner surface 27 of flap 26 covers face 28, (2) smooth at least the external surface of covering material 25 at end 30 so as to present a snag-free surface, (3) compress the layers of core material in flap 26 against face 28 comprising the annular ends of the inner layers, and (4) fair the extremity of flap 26 against the innermost layer of core material on its internal surface, thus, ensuring an essentially constant internal diameter and a void-free interface between flap 26 and face 28. Because the length Y of flap 26 is essentially the same as the wall thickness X of the cylindrical stock, covering material 25 and the underlying layer(s) of core material now protect this end of the yarn support, as illustrated in FIG. 5.

Figure 6:
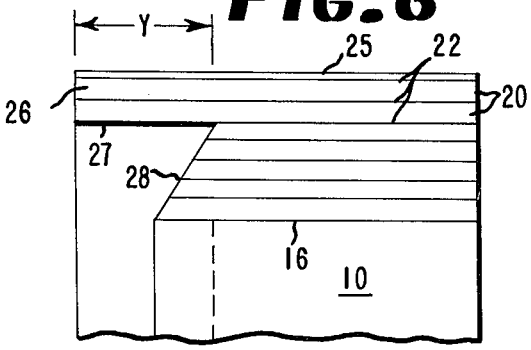
FIGS. 6 and 7 are views in partial cross-section, to show an intermediate stage in the preparation of alternative embodiments of the invention.
Figure 8:
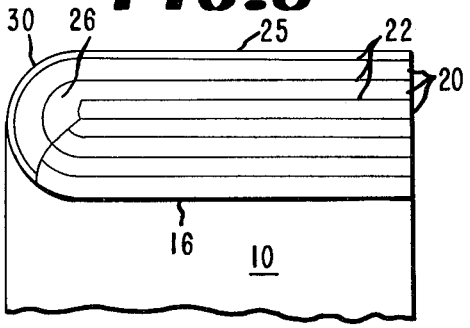
FIGS. 8 and 9 are views in partial cross-section of the ends of embodiments of the invention obtained from the intermediate stages shown in FIGS. 6 and 7, respectively.
Figure 7:
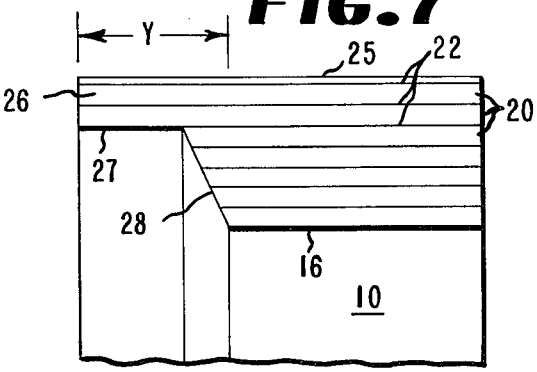
Figure 9:
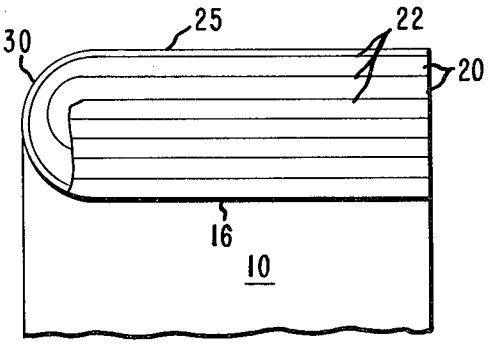

It will generally be preferred to make any cuts in a plane essentially perpendicular to the axis of the stock, as illustrated in FIG. 2, but it may sometimes be preferred to achieve a slanting surface, e.g. by making a tapered cut or by making an essentially perpendicular cut followed by grinding to achieve a tapered surface 28 slanting in either direction from the perpendicular as shown in FIGS. 6 and 7, and then burnishing to give the configurations shown in FIGS. 8 and 9, respectively, for example.

FIG. 2 shows the preferred process of making two cuts 17 and 18, followed by breaking off portion 11 as shown in FIG. 3. If desired, however, the same result can be achieved by making one cut through the whole of the cylindrical stock at location 18, and removing the appropriate amount of the core material from the inner layers up to location 17, e.g. by routing or grinding, so as to achieve configurations, e.g., as shown in FIGS. 3, 8 and 9, with flap 26 extending beyond face 28 by a distance Y.

For yarn supports containing string-up slots, it will generally be desired to cut the cylindrical stock into sections slightly longer than the desired length for the final yarn supports, then to form a snag-free surface at one end by carrying out a process according to the invention, e.g. as particularly described above, and then to make the string-up slot for the transfer tail at the desired distance from the snag-free end.

The radial depths of the cuts may be varied, and the optimum depth may well depend on the nature of the materials of construction and on the total wall thickness, the number of layers of core material and the thickness of such layers, but it will generally be preferable to make the depth of the internal cut at least 50% of the total wall thickness. It is preferred that the external flap not be so thick as to inhibit smooth bending of the flap so as to provide the desired smooth snag-free contour.

An advantage of the process of the present invention is that the yarn supports may be prepared by unsophisticated fabrication techniques. The process of cutting and shearing the end is essentially similar to that described in Sowell U.S. Pat. No. 3,794,260 for a breakaway string-up slot, although the intention then was not to provide an external flap of specific dimensions. The burnishing operation is already conventional in this art.

The yarn supports of the present invention are advantageous since the unwinding end presents a smooth snag-free contour and yet has sufficient strength to withstand normal handling operations. Thus, the unwinding end comprises essentially the same covering as the winding surface, and this covering is supported by compacted core material that has been compressed so as to minimize the possibility of mechanical deformation or penetration by moisture. The compaction of the core material and the provision of a void-free interface with the inner surface of the yarn support is important because, after cutting or shearing, the exposed layers of core material will have an increased susceptibility to penetration by moisture in the absence of some treatment such as burnishing.

It will be understood that it is important to provide an essentially uninterrupted internal surface by fairing the flap thereto, because it is important to avoid protrusion inwards of any part of the yarn support, such as could be liable to happen upon deformation of a soft end of a support. It should also be understood that it is advantageous to have an internal surface of rounded configuration, rather than a sharp edge between the internal surface and the end of the yarn support.

The yarn support may be made of conventional materials. Although conventional yarn supports are generally of cylindrical form, the invention can be adapted to yarn supports of other configurations, e.g. of hollow frustroconical configuration.

Conventionally, cylindrical yarn supports are spirally wound from layers of paperboard stock of thickness varying from, e.g. one-eighth inch (3.2 mm) nominal wall thickness containing, e.g., 6 layers of paperboard, through 5/32 inch (4mm) nominal wall thickness containing, e.g., 7 layers of paperboard and 9/32 inch (7.1 mm) nominal wall thickness containing, e.g., 11 layers of paperboard up to one-half inch (12.7 mm) and even seven-eighth inch (22.2 mm) nominal wall thickness, but the supports of larger wall thickness are used generally for heavy denier yarns, e.g. for industrial purposes, which are generally relatively strong and snag-resistant. The invention is expected to be of greater value for winding lower denier yarns, e.g. of 3–12 denier per filament, such as are suitable for apparel and related textile purposes. It has generally been found desirable to have the flap of covering material and outer layers of core material less than 0.05 inch (1.3 mm), and preferably at least 0.025 inch (0.65 mm) but the precise values will depend on the particular materials used. For a standard 2 × 11 inch (5 × 28 cm) core of nominal wall thickness 5/32 inch (4 mm) containing 7 layers of paperboard, such as is used for some conventional polyester apparel yarn, I have found it advantageous to use an external flap comprising the parchment layer of thickness 3 mils (0.08 mm) and 2 layers of paper-board each of thickness 11 mils (0.28 mm), amounting to about 1/6 of the thickness of the wall; it should be understood that the thickness of the various layers may differ, and in this specific instance the 2 outer layers of paperboard are significantly thinner than the 5 inner layers.

The burnishing operation will be adjusted according to the materials used. With the 5/32 (4 mm) core indicated above, a burnishing axial pressure of 150–200 psi (10–14 kg/sq.cm.) and a rotational speed of 1750 rpm were used. As indicated above, the flap is compacted over the end of the support, i.e. the core material is compressed to a density higher than that of the rest of the core and this is advantageous in resisting deformation and providing better control in obtaining any precise length from this end to the string-up slot. I have found that the density of paperboard core material at this end of the support is, e.g., about 10–60% greater than the density of the paperboard in the rest of the support. I have found that the resistance to deformation of the end of the support is improved, and that deformation of the support occurs in a location other than the end, in contrast to some prior art supports.

It is important that the burnishing operation should be operated to smooth the water-resistant covering material, usually parchment, to present a snag-free surface. It has been found that the burnishing operation stretches the parchment where necessary so as to form the desired configuration conforming to the dished cavity of the burnishing tool.

I claim:

1. A hollow laminated yarn support comprising superposed bonded layers of core material with an external surface of water-resistant covering material and an internal surface, a flap of the covering material and of at least the outermost layer(s) of core material abutting one end of the remaining inner layers of core material along the inner surface of said flap, the end of said flap being faired into the internal surface of the support, whereby the flap protects an end of the support to present a snag-free surface on at least its external face.

2. A support according to claim 1 of essentially hollow cylindrical configuration.

3. A support according to claim 2, wherein a string-up slot is provided near the other end.

4. A support according to claim 2, wherein both ends are protected with such a snag-free flap of covering material on at least their external faces.

5. A process for preparing a yarn support according to claim 1 from spirally-wound laminated stock comprising superposed bonded layers of core material with an external water-resistant covering material, comprising the steps of:

A. Cutting into the external and internal surface of the stock at locations that are separated axially from each other, and to depths such as to sever at both locations at least one common glue line between the layers of core material;

B. Removing an end portion by breaking and shearing along said common glue line to leave an external flap extending beyond the remainder of the stock by an axial distance essentially equal to the wall thickness of the stock and comprising the water-resistant covering material and at least the outermost layer(s) of the core material; and C. burnishing to fold said external flap radially inwards over the remaining layers of core material, to stretch and smooth the water-resistant covering material to a snag-free external surface and to compress said outermost layer(s) of the core material against the end of said remaining layers of core material, and to fair the extremity of the flap against the innermost layer of core material on its internal surface.

6. A process according to claim 5, wherein the yarn support is prepared from cylindrical stock.

7. A process according to claim 6, wherein the said cutting is performed in a direction essentially perpendicular to the axis of the cylindrical stock.

8. A process according to claim 6, wherein the said remainder of the stock is formed with a face that slants relative to the axis of the cylindrical stock before step C.

* * * * *